US010310399B2

(12) United States Patent
Matsushita et al.

(10) Patent No.: US 10,310,399 B2
(45) Date of Patent: Jun. 4, 2019

(54) TONER, IMAGE FORMING APPARATUS, IMAGE FORMING METHOD, AND TONER STORED UNIT

(71) Applicants: Natsuko Matsushita, Shizuoka (JP); Tomomi Suzuki, Shizuoka (JP); Kohtaroh Ogino, Shizuoka (JP); Tohru Moriya, Shizuoka (JP)

(72) Inventors: Natsuko Matsushita, Shizuoka (JP); Tomomi Suzuki, Shizuoka (JP); Kohtaroh Ogino, Shizuoka (JP); Tohru Moriya, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 55 days.

(21) Appl. No.: 15/536,531

(22) PCT Filed: Nov. 26, 2015

(86) PCT No.: PCT/JP2015/005884
§ 371 (c)(1),
(2) Date: Jun. 15, 2017

(87) PCT Pub. No.: WO2016/098290
PCT Pub. Date: Jun. 23, 2016

(65) Prior Publication Data

US 2018/0329326 A1 Nov. 15, 2018

(30) Foreign Application Priority Data

Dec. 19, 2014 (JP) ..... 2014-256990
Jul. 27, 2015 (JP) ..... 2015-147500
Nov. 16, 2015 (JP) ..... 2015-223698

(51) Int. Cl.
*G03G 9/08* (2006.01)
*G03G 9/087* (2006.01)
*G03G 15/08* (2006.01)

(52) U.S. Cl.
CPC ..... *G03G 9/08797* (2013.01); *G03G 9/081* (2013.01); *G03G 9/0821* (2013.01);
(Continued)

(58) Field of Classification Search
CPC ..... G03G 9/087; G03G 9/08755
(Continued)

(56) References Cited

U.S. PATENT DOCUMENTS 5,403,690 A 4/1995 Kuramoto et al.
5,554,478 A 9/1996 Kuramoto et al.
(Continued)

FOREIGN PATENT DOCUMENTS

EP 2 648 045 A1 10/2013
EP 2 869 126 A1 5/2015
(Continued)

OTHER PUBLICATIONS

International Search Report and Written Opinion issued Feb. 23, 2016 for counterpart International Patent Application No. PCT/JP2015/005884 dated Nov. 26, 2015.
(Continued)

*Primary Examiner* — Mark A Chapman
(74) *Attorney, Agent, or Firm* — Oblon, McClelland, Maier & Neustadt, L.L.P.

(57) ABSTRACT

Provided is a toner including at least a binder resin, and having peak ratio W/R of from 0.20 to 0.70 when measured with FT-IR according to ATR method, W/R being a ratio of height W of maximum spectral peak attributed to bisphenol A skeleton of the toner and observed at from 1,480 $cm^{-1}$ to 1,520 $cm^{-1}$ to height R of maximum spectral peak attributed to carbonyl group of the toner and observed at from 1,700 $cm^{-1}$ to 1,750 $cm^{-1}$, wherein molecular weight distribution of the toner obtained by GPC of THF-soluble component of the toner has main peak in a range of from 1,000 to 10,000,
(Continued)

half value width of the molecular weight distribution is a molecular weight of 20,000 or less, and content of a THF-insoluble component in the toner is from 5% by mass to 40% by mass.

9 Claims, 1 Drawing Sheet

(52) U.S. Cl.
CPC ..... *G03G 9/08755* (2013.01); *G03G 9/08782* (2013.01); *G03G 9/08795* (2013.01); *G03G 15/08* (2013.01)

(58) Field of Classification Search
USPC ..... 430/109.4
See application file for complete search history.

(56) References Cited

U.S. PATENT DOCUMENTS

| | | | | |
|---|---|---|---|---|
| 5,840,456 | A | 11/1998 | Tomita et al. | |
| 6,074,794 | A | 6/2000 | Fushimi et al. | |
| 6,303,258 | B1 | 10/2001 | Katoh et al. | |
| 6,406,826 | B1 | 6/2002 | Suzuki et al. | |
| 6,500,595 | B1 | 12/2002 | Mochizuki et al. | |
| 6,902,858 | B2 | 6/2005 | Mochizuki et al. | |
| 7,374,851 | B2 | 5/2008 | Nakayama et al. | |
| 7,504,188 | B2 | 3/2009 | Yamada et al. | |
| 9,063,446 | B2 * | 6/2015 | Miyaake | G03G 9/0821 |
| 9,316,938 | B2 * | 4/2016 | Watanabe | G03G 9/08755 |
| 9,639,017 | B2 * | 5/2017 | Lee | G03G 9/0906 |
| 2002/0155366 | A1 | 10/2002 | Mochizuki et al. | |
| 2002/0160290 | A1 | 10/2002 | Sugiura et al. | |
| 2002/0181971 | A1 | 12/2002 | Mochizuki et al. | |
| 2003/0138718 | A1 | 7/2003 | Yagi et al. | |
| 2003/0152857 | A1 | 8/2003 | Sugiura et al. | |
| 2003/0180643 | A1 | 9/2003 | Suzuki et al. | |
| 2003/0186154 | A1 | 10/2003 | Suzuki et al. | |
| 2003/0232266 | A1 | 12/2003 | Sugiura et al. | |
| 2005/0112488 | A1 | 5/2005 | Yamada et al. | |
| 2007/0218383 | A1 | 9/2007 | Seshita et al. | |
| 2008/0076055 | A1 | 3/2008 | Sawada et al. | |
| 2008/0213682 | A1 | 9/2008 | Saitoh et al. | |
| 2008/0227018 | A1 | 9/2008 | Awamura et al. | |
| 2008/0268366 | A1 | 10/2008 | Nakayama et al. | |
| 2008/0292361 | A1 | 11/2008 | Seshita et al. | |
| 2008/0311500 | A1 | 12/2008 | Yamada et al. | |
| 2009/0117480 | A1 | 5/2009 | Yamada et al. | |
| 2009/0142094 | A1 | 6/2009 | Sawada et al. | |
| 2009/0142682 | A1 | 6/2009 | Saitoh et al. | |
| 2009/0280421 | A1 | 11/2009 | Awamura et al. | |
| 2010/0119255 | A1 | 5/2010 | Seshita et al. | |
| 2012/0070774 | A1 | 3/2012 | Satoh et al. | |
| 2013/0260307 | A1 | 10/2013 | Nagayama et al. | |
| 2014/0099577 | A1 | 4/2014 | Moribe et al. | |

FOREIGN PATENT DOCUMENTS

| | | |
|---|---|---|
| JP | 2002-082484 | 3/2002 |
| JP | 2007-033773 | 2/2007 |
| JP | 2008-275865 | 11/2008 |
| JP | 2009-175755 | 8/2009 |

OTHER PUBLICATIONS

Extended European Search Report dated Sep. 21, 2017 in Patent Application No. 15869500.7.

* cited by examiner

[Fig. 1]
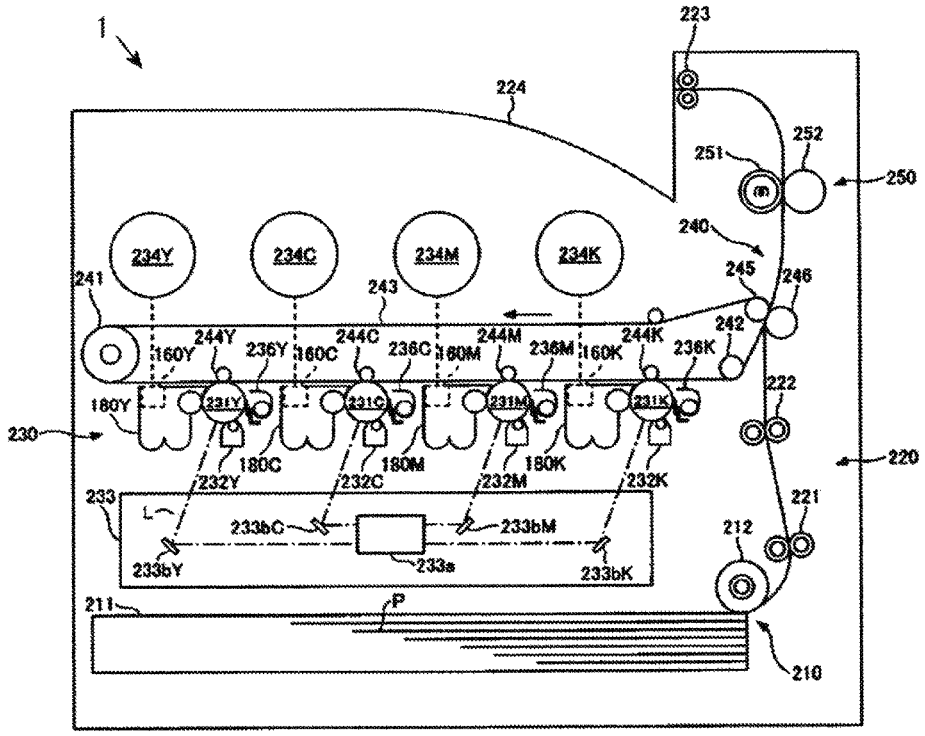
[Fig. 2]
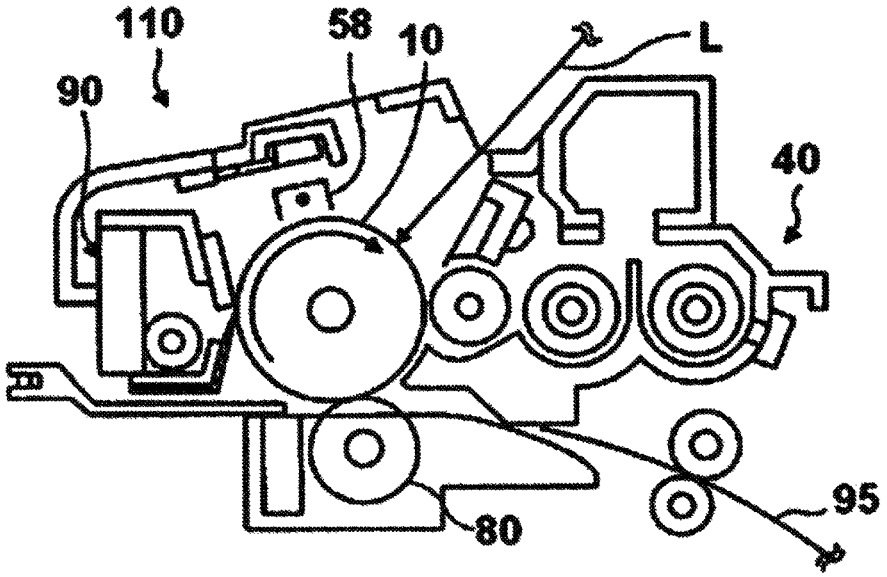

TONER, IMAGE FORMING APPARATUS, IMAGE FORMING METHOD, AND TONER STORED UNIT

TECHNICAL FIELD

The present invention relates to a toner, an image forming apparatus, an image forming method, and a toner stored unit used for electrophotography, electrostatic recording, electrostatic printing, etc.

BACKGROUND ART

Toners used in electrophotographic copiers and printers are typically mixtures containing a plurality of substances such as a binder resin as a main component, a colorant, a release agent, and a charge controlling agent. Pulverized toners having a desired particle diameter can be obtained by melting and kneading these raw materials and pulverizing and classifying the resulting melted-kneaded product. Among the raw materials of the toners, the binder resin typically accounts for 80% by mass to 90% by mass and occupies a most part of the toners.

In recent years, it has become common to use polyester resins as binder resins of toners from the viewpoints of reducing power consumption in the copiers and reducing environmental impacts, because polyester resins can make toners easily fixable even at a low fixing temperature. Polyester resins for toners typically contain a bisphenol A skeleton in an alcohol monomer constituting the resins. Therefore, these polyester resins have excellent low-temperature fixability and also a sharp melting property that imparts excellent gloss level to the polyester resins. These properties make the polyester resins particularly suitable for full-color toners. However, there is a problem that the bisphenol A skeleton makes the polyester resins poorly pulverizable during toner production. Furthermore, although the polyester resins for toners have excellent low-temperature fixability, the polyester resins for toners often cause so-called copy blocking of printed sheets of paper being stuck to each other when the printed sheets ejected continuously from copiers form a large stack of sheets as is often the case in the fields of high-speed machines. Therefore, improvement of blocking resistance is a major issue.

Hence, there have been proposed polyester resins suppressed in bisphenol A skeletons in the resins in order to satisfy both of low-temperature fixability and pulverizability. PTL 1 proposes a toner resin and a toner composition that are made of a polyester resin obtained by polycondensing an alcohol component and a carboxylic acid component.

In this polyester resin, 80 mol % to 100 mol % of the carboxylic acid component is at least one of a terephthalic acid, an isophthalic acid, and lower alkyl esters thereof (with 1 to 4 carbon atoms on an alkyl group), 20 mol % to 100 mol % of the alcohol component is an aliphatic diol (85 mol % to 100 mol % of the aliphatic diol being 1,2-propylene glycol), and 0.1 mol % to 20 mol % of the total amount of the alcohol component and the carboxylic acid component is at least one of a trihydric or higher multihydric alcohol and a trivalent or higher carboxylic acid.

The invention of PTL 1 uses an aliphatic alcohol as an alcohol component in order to suppress bisphenol A skeletons in the alcohol component. This method can improve low-temperature fixability and pulverizability. However, as a result of suppressing bisphenol A skeletons, this method may degrade stress resistance (durability) so that the toner may be deteriorated due to stress of being stirred in a developing device, etc., and may also degrade filming resistance so that the toner may contaminate members such as a photoconductor. That is, this method is insufficient for satisfying stress resistance, filming resistance, and blocking resistance at the same time as satisfying fixability and pulverizability.

CITATION LIST

Patent Literature

PTL 1: Japanese Patent (JP-B) No. 5138630

SUMMARY OF INVENTION

Technical Problem

Objects of the present invention are as follows:

To provide a toner excellent in durability.

To provide a toner that is excellent in low-temperature fixability, pulverizability during toner production, and copy blocking resistance, is also excellent in filming resistance, and is low-cost.

Solution to Problem

As a result of earnest studies for overcoming these problems, the present inventors have completed the present invention with a finding that a toner that contains at least a binder resin and has a peak ratio W/R of from 0.20 to 0.70 when measured with a Fourier Transform InfraRed spectroscopic analytical measuring instrument (FT-IR) according to an Attenuated Total Reflection (ATR) method (total reflection method) is a toner excellent in low-temperature fixability, pulverizability during toner production, copy blocking resistance, durability, and filming resistance, where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$.

That is, the toner of the present invention is a toner as described below.

The toner contains at least a binder resin. The toner has a peak ratio (W/R) of from 0.20 to 0.70 when measured with a FT-IR according to an ATR method, where the peak ratio (W/R) is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$. A molecular weight distribution of the toner obtained by GPC of a THF-soluble component of the toner has a main peak in a range of from 1,000 to 10,000. A half value width of the molecular weight distribution is a molecular weight of 20,000 or less. A content of a THF-insoluble component in the toner is from 5% by mass to 40% by mass.

Advantageous Effects of Invention

The toner of the present invention has effects of being excellent in durability, low-temperature fixability, pulverizability during toner production, copy blocking resistance, and filming resistance, and also being low-cost.

BRIEF DESCRIPTION OF DRAWINGS

FIG. 1 is a cross-sectional view illustrating an example configuration of an image forming apparatus of the present invention.

FIG. 2 is a cross-sectional view illustrating an example configuration of a process cartridge of the present invention.

DESCRIPTION OF EMBODIMENTS

In the present invention, "FT-IR" is used as a term referring to a "Fourier Transform InfraRed spectroscopic analytical measuring instrument", and an "ATR method" is used as a term referring to a "total reflection method".

The toner of the present invention contains at least a binder resin, and has a peak ratio W/R of from 0.20 to 0.70 when measured with a FT-IR according to the ATR method, where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$. A molecular weight distribution of the toner obtained by GPC of a THF-soluble component of the toner has a main peak in a range of from 1,000 to 10,000. A half value width of the molecular weight distribution is a molecular weight of 20,000 or less. A content of a THF-insoluble component in the toner is from 5% by mass to 40% by mass.

In the present invention, "GPC" stands for "Gel Permeation Chromatography".

The toner of the present invention will be described in detail below.

First, raw materials including at least a binder resin are blended at a predetermined ratio and mixed.

Next, the mixture is melted and kneaded, and the obtained melted kneaded product is pulverized and classified to obtain a toner.

This toner needs to have a peak ratio W/R of from 0.20 to 0.70 when measured with a FT-IR according to the ATR method, where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$.

The peak ratio W/R of the height W of the maximum spectral peak of the toner observed at from 1,480 $cm^{-1}$ to 1,520 $cm^{-1}$ to the height R of the maximum spectral peak of the toner observed at from 1,700 $cm^{-1}$ to 1,750 $cm^{-1}$ is preferably from 0.20 to 0.65, more preferably from 0.20 to 0.60, and particularly preferably from 0.20 to 0.55. When the W/R value is less than 0.20, filming resistance and durability are poor. When the W/R value is greater than 0.70, pulverizability during toner production and blocking resistance are poor. When the W/R value is in the range of from 0.20 to 0.70, low-temperature fixability and pulverizability during toner production are excellent and can be satisfied at the same time as copy blocking resistance, durability, and filming resistance.

Further, the toner has a peak ratio W'/R' of preferably from 0.06 to 0.70, more preferably from 0.06 to 0.60, and particularly preferably from 0.06 to 0.45 when measured with a FT-IR according to infrared spectroscopy (KBr tablet method), where the peak ratio (W'/R') is a ratio of a height W' of a spectral peak of the toner observed at from 1,480 $cm^{-1}$ to 1,520 $cm^{-1}$ to a height R' of a spectral peak of the toner observed at from 1,700 $cm^{-1}$ to 1,750 $cm^{-1}$. When the W'/R' value is 0.06 or greater, filming resistance and durability are favorable. When the W'/R' value is 0.70 or less, pulverizability and blocking resistance are excellent.

It is preferable that a relationship of $W'/R' \leq W/R$ be established between a peak ratio W/R of a height W of a maximum spectral peak of the toner observed at from 1,480 $cm^{-1}$ to 1,520 $cm^{-1}$ to a height R of a maximum spectral peak of the toner observed at from 1,700 $cm^{-1}$ to 1,750 $cm^{-1}$ when the toner is measured with a FT-IR according to the infrared spectroscopy (KBr tablet method) and the peak ratio (W'/R') of the height W' of the spectral peak of the toner observed at from 1,480 $cm^{-1}$ to 1,520 $cm^{-1}$ to the height R' of the spectral peak of the toner observed at from 1,700 $cm^{-1}$ to 1,750 $cm^{-1}$ when the toner is measured with a FT-IR according to the infrared spectroscopy (KBr tablet method).

When the relationship of $W'/R' \leq W/R$ is established, stress resistance, filming resistance, and low-temperature fixability are particularly excellent, pulverizability and blocking resistance are favorable, and these plurality of properties can be satisfied at high levels.

It is more preferable that a ratio (W/R)/(W'/R') of the peak ratio W/R to the peak ratio W'/R' be from 1.0 to 2.0.

The FT-IR spectral values are values measured with "THERMO NICOLET NEXUS 470 (available from Thermo Fisher Scientific Inc.)" according to the ATR method (total reflection method) and the infrared spectroscopy (KBr tablet method).

A content of a bisphenol A component in a THF-soluble alcohol component contained in the toner is preferably from 20 mol % to 100 mol %, more preferably from 20 mol % to 80 mol %, and particularly preferably from 20 mol % to 50 mol %. A content of a bisphenol A component in a THF-insoluble alcohol component contained in the toner is preferably from 0 mol % to 80 mol %, more preferably from 0 mol % to 50 mol %, and particularly preferably from 0 mol % to 40 mol %. It is preferable that the content of the bisphenol A component in the THF-soluble alcohol component contained in the toner be greater than the content of the bisphenol A component in the THF-insoluble alcohol component contained in the toner.

When these relationships are satisfied, durability, filming resistance, and low-temperature fixability are particularly excellent, pulverizability and blocking resistance are favorable, and these plurality of properties can be satisfied at high levels.

The contents of the bisphenol A component in the THF-soluble and THF-insoluble components can be obtained by dissolving the THF-soluble and THF-insoluble components in deuterated chloroform, finding peaks attributed to various alcohol monomers and acid monomers according to $^{1}$H-NMR (JNM-ECX available from JEOL Ltd.), and calculating a peak area ratio.

The toner of the present invention contains at least a binder resin. A polyester resin is the most appropriate as the binder resin in terms of low-temperature fixability, durability, etc. However, any other resin than a polyester resin may be used alone or blended in an amount that does not spoil these properties.

The polyester resin used in the present invention is obtained by condensation polymerization of an alcohol with a carboxylic acid. Examples of the alcohol include glycols such as ethylene glycol, diethylene glycol, triethylene glycol, and propylene glycol, 1,4-bis(hydroxymethyl)cyclohexane, etherified bisphenols such as bisphenol A, other dihydric alcohol monomers, and trihydric or higher multihydric alcohol monomers. Among these, it is preferable that an aromatic diol such as an etherified bisphenol such as bisphenol A and an aliphatic diol having 2 to 6 carbon atoms be both contained as an alcohol component. Further, it is preferable that at least part of the aliphatic diol be ethylene glycol or 1,2-propylene glycol.

The content of the aliphatic diol having 2 to 6 carbon atoms in the alcohol component is preferably from 5 mol % to 90 mol %, more preferably from 10 mol % to 90 mol %, and particularly preferably from 15 mol % to 85 mol %. When the content of the aliphatic diol having 2 to 6 carbon atoms in the alcohol component is less than 5 mol %, durability and filming resistance are poor. When the content of the aliphatic diol having 2 to 6 carbon atoms in the alcohol component is greater than 90 mol %, pulverizability during toner production and copy blocking resistance are poor. It is preferable that the rest of the alcohol component other than the aliphatic diol having 2 to 6 carbon atoms be an aromatic diol component.

Examples of the carboxylic acid component include divalent organic acid monomers and trivalent or higher multivalent carboxylic acid monomers.

Examples of the divalent organic acid monomers include a maleic acid, a fumaric acid, a phthalic acid, an isophthalic acid, a terephthalic acid, a succinic acid, and a malonic acid.

Examples of the trivalent or higher multivalent carboxylic acid monomers include a 1,2,4-benzene tricarboxylic acid, a 1,2,5-benzene tricarboxylic acid, a 1,2,4-cyclohexane tricarboxylic acid, a 1,2,4-naphthalene tricarboxylic acid, a 1,2,5-hexane tricarboxylic acid, 1,3-dicarboxy-2-methylene carboxy propane, and a 1,2,7,8-octane tetracarboxylic acid.

The toner of the present invention may contain one or more of such polyester resins as described above alone or in combination.

Typically, polyester resins for toners provide desired properties such as fixability when used in combination of a high-molecular-weight polyester resin (hereinafter may be referred to as "H body") with a low-molecular-weight polyester resin (hereinafter may be referred to as "L body"). The THF-insoluble component is attributed to H bodies, and the THF-soluble component is attributed to L bodies and some H bodies.

It is preferable that a H body be contained in terms of hot offset resistance and durability, and in the present invention, it is preferable that an aliphatic diol having 2 to 6 carbon atoms be contained as the alcohol component. The content of the aliphatic diol in the alcohol component of a H-body is preferably from 20 mol % to 100 mol %, more preferably from 50 mol % to 100 mol %, and particularly preferably from 60 mol % to 100 mol %. It is preferable that a L body be contained in terms of low-temperature fixability and pulverizability during toner production, and an aliphatic diol having 2 to 6 carbon atoms may be contained together with an aromatic diol component as the alcohol component of a L-body. The content of the aliphatic diol in the alcohol component is preferably from 0 mol % to 80 mol %, more preferably from 20 mol % to 80 mol %, and particularly preferably from 50 mol % to 80 mol %.

In combining a H body and a L body, it is preferable to add an aliphatic diol component in a greater amount in the H body. This makes it possible to satisfy low-temperature fixability, pulverizability during toner production, and copy blocking resistance at the same time while maintaining durability and filming resistance. The reason why this is possible is that a low-molecular-weight polyester resin component (L body) is easily breakable in pulverization during toner production and can easily come out on the surface of the toner as an interface of the toner, and a low content of an aliphatic diol component i.e., a high content of an aromatic diol component in such a low-molecular-weight polyester resin component (L body) makes it possible to maintain durability, filming resistance, and low-temperature fixability. Meanwhile, a high content of an aliphatic diol component in a high-molecular-weight polyester resin component (H body) makes pulverizability during toner production and blocking resistance favorable. It is considered that these factors lead to satisfying these plurality of properties at high levels.

The W/R value in the present invention is a value mainly relating to the content of bisphenol A in the L body. Appropriate adjustment of the amount of bisphenol A in the L body realizes a toner that expresses a desired W/R value.

A glass transition temperature (Tg) of the polyester resin is typically from 45° C. to 75° C., preferably from 50° C. to 65° C., more preferably from 50° C. to 60° C., and particularly preferably from 55° C. to 60° C. in terms of heat preservability.

A molecular weight distribution of the toner obtained by GPC of the THF-soluble component of the toner has a main peak in the range of from 1,000 to 10,000, more preferably from 2,000 to 8,000, and particularly preferably from 3,000 to 8,000. It is preferable that a half value width of the distribution be a molecular weight of 20,000 or less. When these values are in the ranges described above, a toner excellent in low-temperature fixability can be obtained. Gel Permeation Chromatography (GPC) is performed in the manner described below.

A column is stabilized in a heat chamber of 40° C., THF as a solvent is flowed through the column at this temperature at a flow rate of 1 mL/minute, and a THF sample solution of a resin prepared to a sample concentration of from 0.05% by mass to 0.6% by mass is injected in an amount of from 50 μL to 200 μL and measured. In the measurement of the molecular weight of the sample (toner), a molecular weight distribution of the sample is calculated from a relationship between a logarithmic value of a calibration curve generated based on several kinds of monodisperse polystyrene standard samples and a count value. As the standard polystyrene samples for calibration curve generation, it is adequate to use samples having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$ available from Pressure Chemical Co. or Tosoh Corporation, and use at least about ten standard polystyrene samples. A Refractive Index (RI) detector is used as a detector.

It is preferable that the toner contains a THF-insoluble component in an amount of from 5% by mass to 40% by mass, and more preferably from 10% by mass to 35% by mass. When the content of the THF-insoluble component is in the range described above, a toner having a hot offset resistance and excellent in stress resistance can be obtained.

A half value width of the molecular weight distribution obtained by GPC of the THF-soluble component of the toner is obtained in the manner described below.

The molecular weight is indicated on the horizontal axis and a concentration (mass ratio) is indicated on the vertical axis at an arbitrary height. The horizontal width (molecular weight) of the main peak at a 50% height of the peak top height of the main peak is the half value width.

When there is a different peak at a skirt or the like of the main peak, the half value width is calculated based on the molecular weight including the peak at the skirt. When there is any other peak than the main peak on the horizontal axis at the 50% height of the peak top height of the main peak, the difference between the highest molecular weight and the lowest molecular weight among the molecular weights pointed by the intersections between the horizontal axis and each peak is the half value width.

Examples of usable resins other than the polyester resin include: styrene-based resins (homopolymers or copolymers containing styrene or a styrene substitute) such as polystyrene, chloropolystyrene, poly(α-methylstyrene), a styrene/chlorostyrene copolymer, a styrene/propylene copolymer, a styrene/butadiene copolymer, a styrene/vinyl chloride copolymer, a styrene/vinyl acetate copolymer, a styrene/maleic acid copolymer, styrene/acrylic acid ester copolymers (e.g., a styrene/methyl acrylate copolymer, a styrene/ethyl acrylate copolymer, a styrene/butyl acrylate copolymer, a styrene/octyl acrylate copolymer, and a styrene/phenyl acrylate copolymer), styrene/methacrylic acid ester copolymers (e.g., a styrene/methyl methacrylate copolymer, a styrene/ethyl methacrylate copolymer, a styrene/butyl methacrylate copolymer, and a styrene/phenyl methacrylate copolymer), a styrene/α-methyl chloroacrylate copolymer, and a styrene/acrylonitrile/acrylic acid ester copolymer; a vinyl chloride resin; a styrene/vinyl acetate copolymer; a rosin-modified maleic acid resin; a phenol resin; an epoxy resin; a polyethylene resin; a polypropylene resin; an ionomer resin; a polyurethane resin; a silicone resin; a ketone resin; an ethylene/ethyl acrylate copolymer; a xylene resin; a polyvinyl butyral resin and the like; petroleum-based resins; and hydrogenated petroleum-based resins.

One of these resins may be used alone or two or more of these may be used in combination. A method for producing these resins is not particularly limited, and any of bulk polymerization, solution polymerization, emulsion polymerization, and suspension polymerization may be used.

Like the polyester resin, a glass transition temperature Tg of the resins described above is preferably 50° C. or higher and more preferably 55° C. or higher in terms of heat preservability.

In the present invention, a release agent used in the toner may be any of all known release agents. In particular, desolated fatty acid carnauba waxes, montan waxes, and oxidized rice waxes may be used alone or in combination. A preferable carnauba wax is microcrystalline, has an acid value of 5 or less, and has a particle diameter of 1 μm or less when dispersed in the binder resin. The montan waxes generally refer to montan-based waxes refined from minerals, and a preferable montan wax is microcrystalline like the carnauba wax and has an acid value of from 5 to 14. The oxidized rice waxes are aerially oxidized rice bran waxes, and a preferable oxidized rice wax has an acid value of from 10 to 30. Other examples of usable release agents that may be mixed include all conventionally-known release agents such as solid silicone varnishes, higher fatty acids, higher alcohols, montan-based ester waxes, and low-molecular-weight polypropylene waxes. An amount of use of these release agents is from 1 part by mass to 20 parts by mass and preferably from 3 parts by mass to 10 parts by mass relative to the resin components of the toner.

In the present invention, a colorant may be used as a toner component as needed.

Examples of colorants that may be used alone or as a mixture and may be used both as black toners and full-color toners include all conventionally-known dyes and pigments such as carbon black, lamp black, iron black, aniline blue, phthalocyanine blue, phthalocyanine green, Hansa yellow G, rhodamine 6C lake, calco oil blue, chrome yellow, quinacridone, benzidine yellow, rose bengal, and triallyl methane-based dyes. An amount of use of these colorants is typically from 1% by mass to 30% by mass and preferably from 3% by mass to 20% by mass relative to the resin components of the toner.

The toner of the present invention may contain a charge controlling agent, a flowability modifier, etc. as needed. Examples of charge controlling agents that may be used alone or as a mixture include all conventionally-known charge controlling agents such as nigrosine dyes, metal complex dyestuff, and quaternary ammonium salts. An amount of use of these charge controlling agents is from 0.1 parts by mass to 10 parts by mass and preferably from 1 part by mass to 5 parts by mass relative to the resin components of the toner. In particular, salicylic acid metal complexes, and particularly complexes containing a trivalent or higher metal that may take a hexacoordinated configuration are preferable for the reason described above. Examples of the trivalent or higher metal include Al, Fe, Cr, and Zr. Examples of flowability modifiers that may be used alone or as a mixture include all conventionally-known flowability modifiers such as silicon oxide, titanium oxide, silicon carbide, aluminium oxide, and barium titanate. An amount of use of these flowability modifiers is from 0.1 parts by mass to 5 parts by mass and preferably from 0.5 parts by mass to 2 parts by mass relative to the mass of the toner.

The toner of the present invention may be used as a magnetic toner containing a magnetic body. Examples of magnetic materials that may be contained in the toner include metals such as iron oxides such as magnetite, hematite, and ferrite, iron, cobalt, and nickel, or alloys of these metals with aluminium, cobalt, copper, lead, magnesium, tin, zinc, antimony, beryllium, bismuth, cadmium, calcium, manganese, selenium, titanium, tungsten, and vanadium, and mixtures thereof. In particular, magnetite is preferable in terms of a magnetic property.

These magnetic bodies preferably have an average particle diameter of from 0.1 μm to 2 μm. An amount of these magnetic bodies to be contained in the toner is from 15 parts by mass to 200 parts by mass relative to 100 parts by mass of the resin components, and particularly preferably from 20 parts by mass to 100 parts by mass relative to 100 parts by mass of the resin components.

The toner of the present invention may be used both as a one-component developer and a two-component developer in combination with a carrier. The carrier of the case where the toner of the present invention is used as a two-component developer may be any of all known carriers. Examples of such carriers include magnetic powders such as iron powders, ferrite powders, and nickel powders, glass beads, and glass beads surface-treated with a resin or the like. Examples of resin powders with which the carrier of the present invention may be coated include a styrene-acrylic copolymer, a silicone resin, a maleic acid resin, a fluorine-based resin, a polyester resin, and an epoxy resin. A preferable styrene-acrylic copolymer contains a styrene moiety in an amount of from 30% by mass to 90% by mass. This range is preferable for the following reasons. When the styrene moiety is less than 30% by mass, developability is poor. When the styrene moiety is greater than 90% by mass, the coating film is hard and easily peels off to shorten the life of the carrier. The resin coating of the carrier of the present invention may contain a tackifier, a curing agent, a lubricant, a conductive material, a charge controlling agents, etc. in addition to the resin described above.

In any of the case where the toner of the present invention is used as a one-component developer and the case where the toner of the present invention is used as a two-component developer, it is common that the toner is filled in a container, the container filled with the toner is distributed separately from an image forming apparatus, and a user attaches the container to an image forming apparatus for image formation. The container to be used is not particularly limited, and any container that is not particularly limited to a conventional bottle or cartridge may be used. The image forming apparatus is not particularly limited except that the image forming apparatus is an apparatus configured to form an image by electrophotography, and examples of the image forming apparatus include copiers and printers.

(Image Forming Apparatus and Image Forming Method)

An image forming apparatus of the present invention includes at least an electrostatic latent image bearer, a charging unit, an electrostatic latent image forming unit, a developing unit, a transfer unit, and a fixing unit, and further includes other units as needed.

An image forming method of the present invention includes at least an electrostatic latent image forming step, a developing step, a transfer step, and a fixing step, and further includes other steps as needed.

<Electrostatic Latent Image Bearer>

The constituent material, structure, and size of the electrostatic latent image bearer are not particularly limited, and an arbitrary electrostatic latent image bearer may be selected from known electrostatic latent image bearers. In terms of the constituent material, examples of the electrostatic latent image bearer include inorganic photoconductors made of amorphous silicon, selenium, etc., and organic photoconductors made of polysilane, phthalopolymethine, etc. Among these, amorphous silicon is preferable because amorphous silicon has a long life.

<Electrostatic Latent Image Forming Unit and Electrostatic Latent Image Forming Step>

The electrostatic latent image forming unit is not particularly limited, and an arbitrary electrostatic latent image forming unit may be selected according to the purpose as long as such an electrostatic latent image forming unit is configured to form an electrostatic latent image over the electrostatic latent image bearer. Examples of the electrostatic latent image forming unit include a unit including at least a charging unit configured to electrically charge the surface of the electrostatic latent image bearer and an exposing member configured to expose the surface of the electrostatic latent image bearer to light imagewise.

The electrostatic latent image forming step is not particularly limited, and an arbitrary electrostatic latent image forming step may be selected according to the purpose as long as such an electrostatic latent image forming step is a step of forming an electrostatic latent image over the electrostatic latent image bearer. For example, the electrostatic latent image forming step can be performed by electrically charging the surface of the electrostatic latent image bearer and then exposing the surface of the electrostatic latent image bearer to light imagewise, and can be performed by the electrostatic latent image forming unit.

<<Charging Unit and Charging>>

The charging unit is not particularly limited, and an arbitrary charging unit may be selected according to the purpose. Examples of the charging unit include known contact chargers including a conductive or semi-conductive roller, brush, film, rubber blade, or the like, and contactless chargers utilizing a corona discharge, such as a corotron and a scorotron.

The charging can be performed by, for example, applying a voltage to the surface of the electrostatic latent image bearer with the charging unit.

The charging unit may have any form such as a roller, a magnetic brush, and a fur brush, and the form of the charging unit may be selected according to the specifications and form of the image forming apparatus.

The charging unit is not limited to the contact charging unit, but use of a contact charging unit is preferable because this realizes an image forming apparatus with reduced ozone emissions from the charging unit.

<<Exposing Member and Exposing>>

The exposing member is not particularly limited, and an arbitrary exposing member may be selected according to the purpose as long as such an exposing member is capable of exposing the surface of the electrostatic latent image bearer electrically charged by the charging unit to light imagewise as a desired image. Examples of the exposing member include various exposing members such as a copier optical system, a rod lens array system, a laser optical system, and a liquid crystal shutter optical system.

A light source used for the exposing member is not particularly limited, and an arbitrary light source may be selected according to the purpose. Examples of the light source include all light-emitting matters such as a fluorescent lamp, a tungsten lamp, a halogen lamp, a mercury lamp, a sodium-vapor lamp, a Light-Emitting Diode (LED), a Laser Diode (LD), and Electro-Luminescence (EL).

For irradiation of light in only a desired wavelength range, various filters such as a sharp cut filter, a band-pass filter, a near infrared cut filter, a dichroic filter, an interference filter, and a color conversion filter may be used.

The exposing can be performed by exposing the surface of the electrostatic latent image bearer to light imagewise with the exposing member.

In the present invention, it is possible to employ a back-lighting system configured to perform exposing of the electrostatic latent image bearer to light imagewise at the back side of the electrostatic latent image bearer.

<Developing Unit and Developing Step>

The developing unit is not particularly limited, and an arbitrary developing unit may be selected according to the purpose as long as such a developing unit includes a toner and is configured to develop the electrostatic latent image formed over the electrostatic latent image bearer to form a toner image, which is a visible image.

The developing step is not particularly limited, and an arbitrary developing step may be selected according to the purpose as long as such a developing step is a step of developing the electrostatic latent image formed over the electrostatic latent image bearer with a toner to form a toner image, which is a visible image. The developing step can be performed by, for example, the developing unit.

As the developing unit, a developing device including: a stirrer configured to frictionally stir the toner and charge the toner electrically; and a developer bearer including an internally secured magnetic field generating unit and rotatable while bearing a developer containing the toner on the surface of the developer bearer is preferable.

<<Developer>>

A developer of the present invention contains at least the toner, and further contains appropriately selected other components such as a carrier as needed.

For use in a high-speed printer or the like that accommodates the recent improvement in the information processing speed, a two-component developer including a toner and a carrier is preferable in terms of a longer life span.

<<<Carrier>>>

The carrier is not particularly limited, and an arbitrary carrier may be selected according to the purpose. Preferable examples of the carrier include a carrier containing a core material and a resin layer coating the core material.

A constituent material of the core material is not particularly limited, and an arbitrary constituent material may be selected according to the purpose. Examples of the constituent material include a manganese-strontium-based material of from 50 emu/g to 90 emu/g, and a manganese-magnesium-based material of from 50 emu/g to 90 emu/g. Use of a highly magnetizable material such as an iron powder of 100 emu/g or greater and magnetite of from 75 emu/g to 120 emu/g is preferable to secure image density. Further, use of a lowly magnetizable material such as a copper-zinc-based material of from 30 emu/g to 80 emu/g is preferable because such a material can ease the impact of the developer in a chain-like form against the photoconductor and is advantageous for a high image quality.

A volume average particle diameter of the core material is not particularly limited and may be appropriately selected according to the purpose. However, the volume average particle diameter is preferably from 10 μm to 150 μm, and more preferably from 40 μm to 100 μm. When the volume average particle diameter is less than 10 μm, the carrier contains many minute particles and has a poorer magnetization per particle that may cause the carrier to scatter. When the volume average particle diameter is greater than 150 μm, the carrier has a small specific surface area to cause the toner to scatter, and may degrade reproducibility of a solid portion, particularly in a full-color image having a large solid portion.

When the toner is used in a two-component developer, the toner may be used as mixed with the carrier. A content of the carrier in the two-component developer is not particularly limited and may be appropriately selected according to the purpose. However, the content is preferably from 90 parts by mass to 98 parts by mass and more preferably from 93 parts by mass to 97 parts by mass relative to 100 parts by mass of the two-component developer.

The developer of the present invention can be favorably used in image formation by various known electrophotographic methods such as a magnetic one-component developing method, a non-magnetic one-component developing method, and a two-component developing method.

In the developing unit, for example, the toner and the carrier are mixed and stirred, which causes a friction by which the toner is electrically charged and retained in a chain-like form over the surface of a rotating magnet roller to form a magnetic brush. The magnet roller is disposed adjacent the electrostatic latent image bearer. Hence, the toner constituting the magnetic brush formed over the surface of the magnet roller is partially moved to the surface of the electrostatic latent image bearer by an electric attractive force. As a result, the electrostatic latent image is developed by the toner, and a visible image of the toner is formed over the surface of the electrostatic latent image bearer.

<Transfer Unit and Transfer Step>

The transfer unit is not particularly limited, and an arbitrary transfer unit may be selected according to the purpose as long as such a transfer unit is a unit configured to transfer a visible image onto a recording medium. However, in a preferable mode, the transfer unit includes first transfer units configured to transfer visible images onto an intermediate transfer member and form a composite transferred image and a second transfer unit configured to transfer the composite transferred image onto a recording medium.

The transfer step is not particularly limited, and an arbitrary transfer step may be selected according to the purpose as long as such a transfer step is a step of transferring a visible image onto a recording medium. However, in a preferable mode, the transfer step involves use of an intermediate transfer member, performs first transfer of transferring a visible image onto the intermediate transfer member, and then performs second transfer of transferring the visible image onto the recording medium.

The transfer step can be performed by electrically charging the visible image via the photoconductor with a transfer charging device, and can be performed by the transfer unit.

When the image to be secondarily transferred onto the recording medium is a color image made of toners of a plurality of colors, the transfer unit may sequentially overlay the toners of the respective colors over the intermediate transfer member and form images over the intermediate transfer member, and the intermediate transfer member may secondarily transfer the images over the intermediate transfer member onto the recording medium simultaneously.

The intermediate transfer member is not particularly limited, and an arbitrary intermediate transfer member may be selected from known transfer members according to the purpose. Preferable examples of the intermediate transfer member include a transfer belt.

The transfer member (the first transfer member and the second transfer member) preferably includes a transfer device configured to electrically charge the visible image formed over the photoconductor in a manner that the visible image is peeled toward the recording medium. Examples of the transfer device include a corona transfer device utilizing a corona discharge, a transfer belt, a transfer roller, a pressure transfer roller, and an adhesive transfer device.

The recording medium is typically regular paper, but the recording medium is not particularly limited and an arbitrary recording medium may be selected according to the purpose as long as such a recording medium is a recording medium onto which a developed unfixed image can be transferred. A PET base for OHP and the like may also be used as the recording medium.

<Fixing Unit and Fixing Step>

The fixing unit is not particularly limited, and an arbitrary fixing unit may be selected according to the purpose as long as such a fixing unit is a unit configured to fix a transferred image transferred to the recording medium. However, a known heating pressurizing member is preferable. Examples of the heating pressurizing member include a combination of a heating roller and a pressurizing roller and a combination of a heating roller, a pressurizing roller, and an endless belt.

The fixing step is not particularly limited, and an arbitrary fixing step may be selected according to the purpose as long as such a fixing step is a step of fixing a visible image transferred to the recording medium. For example, the fixing step may be performed for each of the toners of the respective colors when that toner is transferred to the recording medium, or may be performed simultaneously for all of the toners of the respective colors in an overlaid state.

The fixing step can be performed by the fixing unit.

Typically, heating by the heating pressurizing member is preferably from 80° C. to 200° C.

In the present invention, for example, a known optical fixing device may be used together with or instead of the fixing unit according to the purpose.

A contact pressure in the fixing step is not particularly limited and may be appropriately selected according to the purpose. However, the contact pressure is preferably from 10 $N/cm^2$ to 80 $N/cm^2$.

<Other Units and Other Steps>

Examples of the other units include a cleaning unit, a charge removing unit, a recycling unit, and a controlling unit.

Examples of the other steps include a cleaning step, a charge removing step, a recycling step, and a controlling step.

<<Cleaning Unit and Cleaning Step>>

The cleaning unit is not particularly limited, and an arbitrary cleaning unit may be selected according to the purpose as long as such a cleaning unit is a unit capable of remove the toner remaining over the photoconductor. Examples of the cleaning unit include a magnetic brush cleaner, an electrostatic brush cleaner, a magnetic roller cleaner, a blade cleaner, a brush cleaner, and a web cleaner.

The cleaning step is not particularly limited, and an arbitrary cleaning step may be selected according to the purpose as long as such a cleaning step is a step capable of removing the toner remaining over the photoconductor. The cleaning step can be performed by, for example the cleaning unit.

<<Charge Removing Unit and Charge Removing Step>>

The charge removing unit is not particularly limited, and an arbitrary charge removing unit may be selected according to the purpose as long as such a charge removing unit is a unit configured to apply a charge removing bias to the photoconductor and remove charges from the photoconductor. Examples of the charge removing unit include a charge removing lamp.

The charge removing step is not particularly limited, and an arbitrary charge removing step may be selected according to the purpose as long as such a charge removing step is a step of applying a charge removing bias to the photoconductor and removing charges from the photoconductor. The charge removing step can be performed by, for example, the charge removing unit.

<<Recycling Unit and Recycling Step>>

The recycling unit is not particularly limited, and an arbitrary recycling unit may be selected according to the purpose as long as such a recycling unit is a unit configured to recycle the toner removed in the cleaning step to the developing device. Examples of the recycling unit include a known conveying unit.

The recycling step is not particularly limited, and an arbitrary recycling step may be selected according to the purpose as long as such a recycling step is a step of recycling the toner removed in the cleaning step to the developing device. The recycling step can be performed by, for example, the recycling unit.

Next, one mode for carrying out a method for forming an image with the image forming apparatus of the present invention will be described with reference to FIG. 1.

An image forming apparatus 1 is a printer. However, the image forming apparatus 1 is not particularly limited, except that the image forming apparatus 1 is a copier, a facsimile machine, a multifunction peripheral, or the like that is capable of forming an image with a toner.

The image forming apparatus 1 includes a paper feeding section 210, a conveying section 220, an image forming section 230, a transfer section 240, and a fixing device 250.

The paper feeding section 210 includes a paper feeding cassette 211 over which paper sheets P to be fed are stacked and a paper feeding roller 212 configured to feed the paper sheets P stacked over the paper feeding cassette 211 one by one.

The conveying section 220 includes a roller 221 configured to convey a paper sheet P fed by the paper feeding roller 212 in a direction toward the transfer section 240, a pair of timing rollers 222 configured to stand ready while sandwiching a leading end portion of a paper sheet P conveyed by the roller 221 and send forward the sandwiched sheet to the transfer section 240 at a predetermined timing, and a paper ejecting roller 223 configured to eject a paper sheet P over which a color toner image is fixed to a paper ejecting tray 224.

The image forming section 230 includes an image forming unit 180Y configured to form an image using a developer containing a yellow toner, an image forming unit 180C using a developer containing a cyan toner, an image forming unit 180M using a developer containing a magenta toner, and an image forming unit 180K using a developer containing a black toner at predetermined intervals in an order of left to right in the drawing, and an exposing device 233.

When an arbitrary image forming unit among the image forming units (Y, C, M, and K) is to be mentioned, that image forming unit will be referred to as image forming unit.

The developers contain a toner and a carrier.

The four image forming units (Y, C, M, and K) are only different from one another in the developers used, and are substantially identical with one another in the mechanical configuration.

The transfer section 240 includes a driving roller 241 and a driven roller 242, an intermediate transfer belt 243 rotatable anticlockwise in the drawing along with driving by the driving roller 241, first transfer rollers (244Y, 244C, 244M, and 244K) disposed to face photoconductor drums 231 via the intermediate transfer belt 243, and a second counter roller 245 and a second transfer roller 246 disposed to face each other via the intermediate transfer belt 243 at a position at which a toner image is transferred to a sheet.

The fixing device 250 includes a fixing belt 251 including an internal heater and configured to heat a paper sheet P and a pressurizing roller 252 configured to rotatably pressurize the fixing belt 251 and form a nip with the fixing belt 251. Hence, heat and pressure are applied to a color toner image over a paper sheet P and the color toner image is fixed on the paper sheet P. The paper sheet P on which the color toner image is fixed is ejected by the paper ejecting roller 223 to the paper ejecting tray 224. In this way, a sequence of an image forming process is completed.

(Toner Stored Unit)

A toner stored unit of the present invention refers to a unit having a toner storing function and having stored a toner. Examples of the form that the toner stored unit may take include a toner stored container, a developing device, and a process cartridge.

A toner stored container refers to a container having stored a toner.

A developing device refers to a device including a unit having stored a toner and configured to develop an image with the toner.

A process cartridge refers to a cartridge including at least an image bearer and a developing unit in an integrated from, having stored a toner, and attachable to and detachable from an image forming apparatus. The process cartridge may further include at least one selected from a charging unit, an exposing unit, and a cleaning unit.

Image formation with an image forming apparatus to which the toner stored unit of the present invention is attached leads to image formation with the toner of the present invention excellent in durability, low-temperature fixability, pulverizability during toner production, copy blocking resistance, and filming resistance. This provides an effect that an image with a good quality can be obtained at a low cost.

<Process Cartridge>

A process cartridge of the present invention is shaped in a form attachable to and detachable from various image forming apparatuses, and includes at least an electrostatic latent image bearer configured to bear an electrostatic latent image and a developing unit configured to develop an electrostatic latent image borne over the electrostatic latent image bearer with the developer of the present invention to form a toner image. The process cartridge of the present invention may also include other units as needed.

The developing unit includes at least a developer container storing the developer of the present invention, and a developer bearer configured to bear and convey the developer stored in the developer container. The developing unit may further include a regulating member configured to regulate the thickness of the developer borne.

FIG. 2 illustrates an example of a process cartridge of the present invention. The process cartridge 110 includes a photoconductor drum 10, a corona charger 58, a developing device 40, a transfer roller 80, and a cleaning device 90.

EXAMPLES

The present invention will be described below more specifically by way of Examples. However, the present invention is not limited to these Examples. The resins used in Examples are presented in Tables 1-1 and 1-2 and Table 2, and methods for evaluating properties are presented in Tables 3-1 and 3-2.

In the following description, part represents part by mass unless otherwise expressly specified.

Methods for evaluating properties of the toners produced in Examples will be described.

(Evaluating Method)

<1> Low-Temperature Fixability

A copying test was performed by setting sheets TYPE 6200 available from Ricoh Company, Ltd. in an apparatus obtained by remodeling a fixing unit of a copier (MF2200) available from Ricoh Company, Ltd. including a TEFLON (Registered Trademark) roller as a fixing roller. A cold offset temperature (lowest fixable temperature) of the toners was obtained by varying the fixing temperature. A lowest fixable temperature of conventional low-temperature fixable toners is from about 140° C. to 150° C.

Conditions set for evaluating low-temperature fixability include a paper feeding linear velocity of from 120 mm/sec to 150 mm/sec, a contact pressure of 1.2 kgf/cm$^2$, and a nip width of 3 mm. Conditions set for evaluating hot offset include a paper feeding linear velocity of 50 mm/sec, a contact pressure of 2.0 kgf/cm$^2$, and a nip width of 4.5 mm. Criteria for evaluating the property are as follows.

(Evaluation Criteria)

A: 130° C. or higher but lower than 140° C.

B: 140° C. or higher but lower than 150° C.

C: 150° C. or higher but lower than 160° C.

D: 160° C. or higher

<2> Filming Resistance

Continuous printing over a hundred sheets was repeated fifty times with a copier (MP9001) available from Ricoh Company, Ltd. to cause filming of the toners over an electrophotographic photoconductor and evaluate filming resistance according to the criteria below.

(Evaluation Criteria)

A: No filming occurred.

B: A slight filming occurred.

C: Filming occurred at a few points.

D: Much filming occurred.

<3> Durability

Printing was performed continuously over 300,000 sheets with a copier (MP9001) available from Ricoh Company, Ltd. A state of image scatter due to a drop in static buildup in the toners during printing was evaluated. Evaluation criteria are as follows.

(Evaluation Criteria)

A: Static buildup did not drop and no image scatter occurred.

B: Static buildup dropped by 1 μC/g or greater but less than 10 μC/g, but no image scatter occurred.

C: Static buildup dropped by 10 μC/g or greater but less than 20 μC/g, and image scatter occurred.

D: Static buildup dropped by 20 μC/g or greater, and image scatter occurred

<4> Image Blocking Resistance

A total of five blank sheets and test charts (including alternately printed black solid image portions and outline image portions) were stacked alternately, heated at 75° C. under pressure for 6 hours, and then naturally cooled for 1 hour. After this, ID at a portion transferred to a blank sheet was measured, and a toner with a higher ΔID was evaluated to have a poorer blocking resistance. Evaluation criteria are as follows.

(Evaluation Criteria)

A: Less than 0.001

B: 0.001 or greater but less than 0.008

C: 0.008 or greater but less than 0.01

D: 0.01 or greater

<5> Pulverizability

A coarsely pulverized product (with a screen mesh of 1.5 mm) of the toners was pulverized with a mechanical pulverizer (a turbo mill T250) at 9,800 rpm, and a resulting volume average particle diameter was evaluated. Evaluation criteria are as follows.

(Evaluation Criteria)

A: Less than 6.5 μm

B: 6.5 μm or greater but less than 7.0 μm

C: 7.0 μm or greater but less than 7.5 μm

D: 7.5 μm or greater

<6> Cost

A content of bisphenol A in the THF-soluble alcohol component of the toners and a content of bisphenol A in the THF-insoluble alcohol component of the toners were added together to evaluate the cost based on the amount of bisphenol A in the whole of the toners. Evaluation criteria are as follows.

(Evaluation Criteria)

A: 0 mol % or higher but lower than 66 mol %

B: 66 mol % or higher but lower than 140 mol %

C: 140 mol % or higher but lower than 171 mol %

D: 171 mol % or higher but lower than 200 mol %

(Production of Polyester)

A four-necked round flask having a content of 1 L and equipped with a thermometer, a stirrer, a capacitor, and a nitrogen gas introducing tube was charged with the raw materials presented in Tables 1-1 and 1-2 and Table 2 below, set in a mantle heater, and heated while being internally kept under an inert atmosphere with a nitrogen gas introduced through the nitrogen gas introducing tube. Then, 0.05 g of dibutyl tin oxide was added to the flask to promote a reaction with the temperature kept at 200° C., to obtain a polyester resin A to a polyester resin Q.

Example 1

Polyester resin A 60 parts

Polyester resin J 40 parts

Carnauba was 5 parts

Carbon black (#44: available from Mitsubishi Kasei Corporation) 10 parts

Zr (IV) salicylate compound 1 part

A mixture having the composition described above was sufficiently stirred and mixed in a Henschel mixer, then heated and melted with a roll mill at 130° C. to 140° C. for about 30 minutes, and cooled to room temperature, and the obtained kneaded product was pulverized and classified with a jet mill or a mechanical pulverizer and an air classifier to obtain a toner base. 0.5% by mass of hydrophobic silica was added and mixed with the obtained toner base, to obtain a final toner.

Example 2

A toner was obtained in the same manner as in Example 1, except that the polyester resin A of Example 1 was changed to the polyester resin B and the polyester resin J of Example 1 was changed to the polyester resin K.

Example 3

A toner was obtained in the same manner as in Example 1, except that the polyester resin A of Example 1 was changed to the polyester resin C and the polyester resin J of Example 1 was changed to the polyester resin L.

Example 4

A toner was obtained in the same manner as in Example 1, except that the polyester resin A of Example 1 was changed to the polyester resin D and the polyester resin J of Example 1 was changed to the polyester resin M.

Example 5

A toner was obtained in the same manner as in Example 1, except that the polyester resin A of Example 1 was changed to the polyester resin E and the polyester resin J of Example 1 was changed to the polyester resin N.

Example 6

A toner was obtained in the same manner as in Example 1, except that the polyester resin A of Example 1 was changed to the polyester resin F and the polyester resin J of Example 1 was changed to the polyester resin L.

Example 7

A toner was obtained in the same manner as in Example 1 except that the polyester resin A of Example 1 was changed to the polyester resin G and the polyester resin J of Example 1 was changed to the polyester resin O.

Example 8

A toner was obtained in the same manner as in example 1, except that the polyester resin A of Example 1 was changed to the polyester resin H and the polyester resin J of Example 1 was changed to the polyester resin M.

Example 9

A toner was obtained in the same manner as in Example 1, except that the polyester resin A of Example 1 was changed to the polyester resin D and the polyester resin J of Example 1 was changed to the polyester resin M.

Example 10

A toner was obtained in the same manner as in Example 1, except that the polyester resin A of Example 1 was changed to the polyester resin F and the polyester resin J of Example 1 was changed to the polyester resin L.

Example 11

A toner was obtained in the same manner as in Example 1, except that the polyester resin A of Example 1 was changed to the polyester resin D and the polyester resin J of Example 1 was changed to the polyester resin L.

Example 12

A toner was obtained in the same manner as in Example 1, except that the polyester resin A of Example 1 was changed to the polyester resin C and the polyester resin J of Example 1 was changed to the polyester resin N.

Example 13

A toner was obtained in the same manner as in Example 1, except that the polyester resin A of Example 1 was changed to the polyester resin Q and the polyester resin J of Example 1 was changed to the polyester resin K.

Comparative Example 1

Polyester resin F 60 parts

Polyester resin P 40 parts

Carnauba was 5 parts

Carbon black (#44: available from Mitsubishi Kasei Corporation) 10 parts

Zr (IV) salicylate compound 1 part

A mixture having the composition described above was sufficiently stirred and mixed in a Henschel mixer, then heated and melted with a roll mill at 130° C. to 140° C. for about 30 minutes, and cooled to room temperature, and the obtained kneaded product was pulverized and classified with a jet mill or a mechanical pulverizer and an air classifier to obtain a toner base. 0.5% by mass of hydrophobic silica was added and mixed with the obtained toner base, to obtain a final toner.

Comparative Example 2

A toner was obtained in the same manner as in Comparative Example 1, except that the polyester resin F of Comparative Example 1 was changed to the polyester resin I and the polyester resin P of Comparative Example 1 was changed to the polyester resin N.

Comparative Example 3

A toner was obtained in the same manner as in Comparative Example 1, except that the polyester resin F of Comparative Example 1 was changed to the polyester resin D and the polyester resin P of Comparative Example 1 was changed to the polyester resin M.

Comparative Example 4

A toner was obtained in the same manner as in Comparative Example 1, except that the polyester resin P of Comparative Example 1 was changed to the polyester resin L.

The combinations of the polyester resins in Examples and Comparative Examples are presented in Table 3-1.

TABLE 1-1

| | Polyester resin (H body) | A | B | C | D | E |
|---|---|---|---|---|---|---|
| Alcohol component | 1,2-propylene glycol | 12 | 60 | 78 | 96 | 36 |
| | Bisphenol A propylene oxide | 63 | 35 | 25 | 14 | 49 |
| | Bisphenol A ethylene oxide | 45 | 25 | 17 | 10 | 35 |
| Acid component | Terephthalic acid | 85 | 85 | 85 | 85 | 85 |
| | Trimellitic anhydride | 10 | 10 | 10 | 10 | 10 |
| | Adipic acid | 5 | 5 | 5 | 5 | 5 |
| Physical value | Tg | 60 | 59 | 61 | 62 | 60 |
| | Softening temperature | 151 | 156 | 154 | 158 | 153 |
| | Peak top molecular weight Mp | 9,000 | 7,500 | 8,000 | 8,500 | 6,500 |
| | Weight average molecular weight Mw | 9,100 | 8,000 | 8,500 | 9,000 | 7,000 |

TABLE 1-2

| | Polyester resin (H body) | F | G | H | I | Q |
|---|---|---|---|---|---|---|
| Alcohol component | 1,2-propylene glycol | 120 | 54 | 30 | | 72 |
| | Bisphenol A propylene oxide | | 39 | 53 | 70 | 28 |
| | Bisphenol A ethylene oxide | | 27 | 37 | 50 | 20 |
| Acid component | Terephthalic acid | 85 | 85 | 85 | 85 | 85 |
| | Trimellitic anhydride | 10 | 10 | 10 | 10 | 10 |
| | Adipic acid | 5 | 5 | 5 | 5 | 5 |
| Physical value | Tg | 58 | 61 | 60 | 60 | 61 |
| | Softening temperature | 153 | 155 | 156 | 154 | 155 |
| | Peak top molecular weight Mp | 16,000 | 7,300 | 6,300 | 4,800 | 7,200 |
| | Weight average molecular weight Mw | 17,000 | 7,800 | 6,400 | 5,000 | 8,000 |

TABLE 2

| Polyester resin (L body) | | J | K | L | M | N | O | P |
|---|---|---|---|---|---|---|---|---|
| Alcohol component | 1,2-propylene glycol | 60 | 72 | 84 | 24 | | 48 | 120 |
| | Bisphenol A propylene oxide | 35 | 28 | 21 | 56 | 70 | 42 | |
| | Bisphenol A ethylene oxide | 25 | 20 | 15 | 40 | 50 | 30 | |
| Acid component | Terephthalic acid | 98 | 98 | 98 | 98 | 98 | 98 | 98 |
| | Adipic acid | 2 | 2 | 2 | 2 | 2 | 2 | 2 |
| Physical value | Tg | 59 | 60 | 61 | 58 | 60 | 61 | 61 |
| | Softening temperature | 106 | 108 | 121 | 120 | 120 | 118 | 109 |
| | Peak top molecular weight Mp | 5,000 | 4,800 | 5,000 | 7,500 | 7,500 | 6,000 | 5,000 |
| | Weight average molecular weight Mw | 5,100 | 5,000 | 5,500 | 7,700 | 7,700 | 6,300 | 5,100 |

TABLE 3-1

| Ex./Comp. | Combination of polyester resins used | | | | Bisphenol A content (mol %) in alcohol component | Bisphenol A content (mol %) in alcohol component | THF-soluble component |
|---|---|---|---|---|---|---|---|
| Ex. No. | H body | L body | W/R | W'/R' | of H body | of L body | Mp |
| Ex. 1 | A | J | 0.50 | 0.80 | 90 | 50 | 7,000 |
| Ex. 2 | B | K | 0.40 | 0.50 | 50 | 40 | 7,000 |
| Ex. 3 | C | L | 0.30 | 0.20 | 35 | 30 | 7,000 |
| Ex. 4 | D | M | 0.60 | 0.20 | 20 | 80 | 7,000 |

TABLE 3-1-continued

| Ex./Comp. Ex. No. | Combination of polyester resins used H body | L body | W/R | W'/R' | Bisphenol A content (mol %) in alcohol component of H body | Bisphenol A content (mol %) in alcohol component of L body | THF-soluble component Mp |
|---|---|---|---|---|---|---|---|
| Ex. 5 | E | N | 0.70 | 0.65 | 70 | 100 | 7,000 |
| Ex. 6 | F | L | 0.20 | 0.10 | 0 | 30 | 7,000 |
| Ex. 7 | G | O | 0.55 | 0.60 | 55 | 60 | 7,000 |
| Ex. 8 | H | M | 0.70 | 0.75 | 75 | 80 | 7,000 |
| Ex. 9 | D | M | 0.60 | 0.20 | 20 | 80 | 1,000 |
| Ex. 10 | F | L | 0.20 | 0.10 | 0 | 30 | 10,000 |
| Ex. 11 | D | L | 0.2 | 0.15 | 20 | 30 | 8,000 |
| Ex. 12 | C | N | 0.7 | 0.63 | 35 | 100 | 7,000 |
| Ex. 13 | Q | K | 0.4 | 0.35 | 40 | 40 | 7,000 |
| Comp. Ex. 1 | F | P | 0.06 | 0.05 | 0 | 0 | 7,000 |
| Comp. Ex. 2 | I | N | 0.89 | 0.90 | 100 | 100 | 7,000 |
| Comp. Ex. 3 | D | M | 0.60 | 0.20 | 20 | 80 | 900 |
| Comp. Ex. 4 | F | L | 0.20 | 0.10 | 0 | 30 | 15,000 |

TABLE 3-2

| Ex./Comp. Ex. No. | THF-soluble component main peak half value width | THF-insoluble component (% by mass) | Low-temperature fixability | Filming resistance | Dur-ability | Image blocking resistance | Pulver-izability | Cost |
|---|---|---|---|---|---|---|---|---|
| Ex. 1 | 9,500 | 25 | B | B | B | B | C | C |
| Ex. 2 | 9,500 | 25 | B | B | B | B | B | B |
| Ex. 3 | 15,000 | 25 | B | B | B | B | A | A |
| Ex. 4 | 10,500 | 25 | B | A | B | B | A | B |
| Ex. 5 | 9,500 | 25 | A | A | A | B | C | C |
| Ex. 6 | 9,500 | 25 | B | B | B | A | A | A |
| Ex. 7 | 10,500 | 25 | B | B | B | B | B | B |
| Ex. 8 | 10,500 | 25 | A | B | B | B | C | C |
| Ex. 9 | 8,800 | 5 | C | B | C | B | A | B |
| Ex. 10 | 15,000 | 40 | C | B | B | A | C | A |
| Ex. 11 | 15,000 | 35 | B | B | A | A | A | A |
| Ex. 12 | 9,500 | 5 | A | A | A | B | A | B |
| Ex. 13 | 9,500 | 25 | B | A | B | A | B | B |
| Comp. Ex. 1 | 10,500 | 25 | C | D | D | A | A | A |
| Comp. Ex. 2 | 9,500 | 25 | A | A | A | D | D | D |
| Comp. Ex. 3 | 6,000 | 3 | D | D | D | C | A | B |
| Comp. Ex. 4 | 300,000 | 50 | D | A | A | A | D | A |

Example 1

Example 1 satisfied the constitutional conditions of the present invention as a result of combining a L-body resin which was a soluble component when dissolved in tetrahydrofuran (THF) and in which 50 mol % of the alcohol component was bisphenol A and a H-body resin which was an insoluble component when dissolved in THF and in which 90 mol % of the alcohol component was bisphenol A.

Example 1 resulted in a W'/R' value of 0.70 or greater and a high bisphenol A content in the toner, leading to a C-level pulverizability.

Example 2

Example 2 satisfied the constitutional conditions of the present invention and achieved favorable results in all evaluation items as a result of combining a L-body resin which was a soluble component when dissolved in THF and in which 40 mol % of the alcohol component was bisphenol A and a H-body resin which was an insoluble component when dissolved in THF and in which 50 mol % of the alcohol component was bisphenol A.

Example 3

Example 3 satisfied the constitutional conditions of the present invention as a result of combining a L-body resin which was a soluble component when dissolved in THF and in which 30 mol % of the alcohol component was bisphenol A and a H-body resin which was an insoluble component when dissolved in THF and in which 35 mol % of the alcohol component was bisphenol A. Example 3 satisfied all properties in a good balance, but achieved a favorable result particularly in pulverizability owing to a high aliphatic diol content in the THF-insoluble component.

Example 4

Example 4 satisfied the constitutional conditions of the present invention as a result of combining a L-body resin which was a soluble component when dissolved in THF and in which 80 mol % of the alcohol component was bisphenol A and a H-body resin which was an insoluble component when dissolved in THF and in which 20 mol % of the alcohol component was bisphenol A. Example 4 satisfied all properties in a good balance, and achieved a favorable result in filming resistance owing to a high aromatic diol content in the THF-soluble component and a favorable result in pulverizability owing to a high aliphatic diol content in the THF-insoluble component.

Example 5

Example 5 satisfied the constitutional conditions of the present invention as a result of combining a L-body resin which was a soluble component when dissolved in THF and in which 100 mol % of the alcohol component was bisphenol A and a H-body resin which was an insoluble component when dissolved in THF and in which 70 mol % of the alcohol component was bisphenol A. Example 5 achieved favorable results in low-temperature fixability, filming resistance, and durability owing to a high aromatic diol content in the THF-soluble component which was a L body that would easily come out on the surface of the toner.

Example 6

Example 6 satisfied the constitutional conditions of the present invention as a result of combining a L-body resin which was a soluble component when dissolved in THF and in which 30 mol % of the alcohol component was bisphenol A and a H-body resin which was an insoluble component when dissolved in THF and in which 0 mol % of the alcohol component was bisphenol A. Example 6 satisfied all properties in a good balance, and achieved a favorable result in pulverizability owing to a high aliphatic diol content in the THF-insoluble component. Example 6 also achieved a favorable result in blocking resistance owing to a low bisphenol A content in the toner.

Example 7

Example 7 satisfied the constitutional conditions of the present invention and achieved favorable results in all evaluation items as a result of combining a L-body resin which was a soluble component when dissolved in THF and in which 60 mol % of the alcohol component was bisphenol A and a H-body resin which was an insoluble component when dissolved in THF and in which 55 mol % of the alcohol component was bisphenol A.

Example 8

Example 8 satisfied the constitutional conditions of the present invention as a result of combining a L-body resin which was a soluble component when dissolved in THF and in which 80 mol % of the alcohol component was bisphenol A and a H-body resin which was an insoluble component when dissolved in THF and in which 75 mol % of the alcohol component was bisphenol A. However, Example 8 achieved a favorable low-temperature fixability owing to a high aromatic diol content in the THF-soluble component but a C-level pulverizability because of a high bisphenol A content in the toner.

Example 9

Example 9 satisfied the constitutional conditions of the present invention as a result of combining a L-body resin which was a soluble component when dissolved in THF and in which 80 mol % of the alcohol component was bisphenol A and a H-body resin which was an insoluble component when dissolved in THF and in which 20 mol % of the alcohol component was bisphenol A, and as a result of a THF-soluble component Mp of 1,000 and a THF-insoluble component content of 5% by mass. Example 9 achieved a favorable pulverizability owing to a low THF-soluble component Mp and a low THF-insoluble component content.

Example 10

Example 10 satisfied the constitutional conditions of the present invention as a result of combining a L-body resin which was a soluble component when dissolved in THF and in which 30 mol % of the alcohol component was bisphenol A and a H-body resin which was an insoluble component when dissolved in THF and in which 0 mol % of the alcohol component was bisphenol A, and as a result of a THF-insoluble component content of 40% by mass. Example 10 achieved a favorable result in blocking resistance owing to a low bisphenol A content in the toner.

Example 11

Example 11 satisfied the constitutional conditions of the present invention as a result of combining a L-body resin which was a soluble component when dissolved in THF and in which 30 mol % of the alcohol component was bisphenol A and a H-body resin which was an insoluble component when dissolved in THF and in which 20 mol % of the alcohol component was bisphenol A, and as a result of a THF-insoluble component content of 35% by mass. Example 11 satisfied all properties in a good balance, and achieved a favorable result in pulverizability owing to a high aliphatic diol content in the THF-insoluble component and also a favorable result in durability owing to a THF-insoluble component content of 35% by mass.

Example 12

Example 12 satisfied the constitutional conditions of the present invention as a result of combining a L-body resin which was a soluble component when dissolved in THF and in which 100 mol % of the alcohol component was bisphenol A and a H-body resin which was an insoluble component when dissolved in THF and in which 35 mol % of the alcohol component was bisphenol A, and as a result of a THF-insoluble component content of 5% by mass. Example 12 achieved favorable results in low-temperature fixability, filming resistance, and durability owing to a high aromatic diol content in the THF-soluble component which was a L body that would easily come out on the surface of the toner. Example 12 also achieved a favorable result in pulverizability owing to a low THF-insoluble component content of 5% by mass.

Example 13

Example 13 satisfied the constitutional conditions of the present invention and achieved favorable results in all evaluation items as a result of combining a L-body resin which was a soluble component when dissolved in THF and in which 40 mol % of the alcohol component was bisphenol A and a H-body resin which was an insoluble component when dissolved in THF and in which 40 mol % of the alcohol component was bisphenol A, and as a result of a THF-insoluble component content of 25% by mass.

Comparative Example 1

Comparative Example 1 achieved favorable results in image blocking resistance and pulverizability but poor results in filming resistance and durability as a result of combining resins in which the alcohol component was free of bisphenol A as both of a L-body resin which was a soluble component when dissolved in THF and a H-body resin which was an insoluble component when dissolved in THF.

Comparative Example 2

Comparative Example 2 achieved favorable results in low-temperature fixability, filming resistance, and durability but poor results in image blocking resistance and pulverizability as a result of combining resins in which 100 mol % of the alcohol component was bisphenol A as both of a L-body resin which was a soluble component when dissolved in THF and a H-body resin which was an insoluble component when dissolved in THF.

Comparative Example 3

Comparative Example 3 combined a L-body resin which was a soluble component when dissolved in THF and in which 80 mol % of the alcohol component was bisphenol A and a H-body resin which was an insoluble component when dissolved in THF and in which 20 mol % of the alcohol component was bisphenol A, and had a THF-soluble component Mp of 900 and a THF-insoluble component content of 3% by mass. As a result, Comparative Example 3 did not satisfy the constitutional conditions of the present invention because of a low THF-soluble component main peak and a low THF-insoluble component content, and achieved poor results in low-temperature fixability, filming resistance, and durability.

Comparative Example 4

Comparative Example 4 combined a L-body resin which was a soluble component when dissolved in THF and in which 30 mol % of the alcohol component was bisphenol A and a H-body resin which was an insoluble component when dissolved in THF and in which 0 mol % of the alcohol component was bisphenol A, and had a THF-soluble component main peak half value width of 300,000 and a THF-insoluble component content of 50% by mass. As a result, Comparative Example 4 did not satisfy the constitutional conditions of the present invention because of a large THF-soluble component main peak half value width and a high THF-insoluble component content, and achieved poor results in low-temperature fixability and pulverizability.

As presented above, it turned out that the toners of Examples were toners excellent in low-temperature fixability and pulverizability during toner production, and also excellent in copy blocking resistance, stress resistance, and filming resistance.

Aspects of the present invention are as follow, for example.

<1> A toner including at least a binder resin, wherein the toner has a peak ratio W/R of from 0.20 to 0.70 when measured according to a Fourier Transform InfraRed spectroscopic analysis (FT-IR) method according to an Attenuated Total Reflection (ATR) method (total reflection method), where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$, wherein a molecular weight distribution of the toner obtained by Gel Permeation Chromatography (GPC) of a tetrahydrofuran (THF)-soluble component of the toner has a main peak in a range of from 1,000 to 10,000, and a half value width of the molecular weight distribution is a molecular weight of 20,000 or less, and wherein a content of a THF-insoluble component in the toner is from 5% by mass to 40% by mass.

<2> The toner according to <2>, wherein the toner has a peak ratio W'/R' of from 0.06 to 0.70 when measured according to a Fourier Transform InfraRed spectroscopic analysis (FT-IR) method according to infrared spectroscopy (KBr tablet method), where the peak ratio W'/R' is a ratio of a height W' of a spectral peak of the toner observed at from 1,480 $cm^{-1}$ to 1,520 $cm^{-1}$ to a height R' of a spectral peak of the toner observed at from 1,700 $cm^{-1}$ to 1,750 $cm^{-1}$.

<3> The toner according to <2>, wherein the peak ratio W/R and the peak ratio W'/R' satisfies a relationship below, $W'/R' \leq W/R$.

<4> The toner according to any one of <1> to <3>, wherein the binder resin is a polyester resin, and wherein an alcohol component constituting the polyester resin includes a bisphenol A component.

<5> The toner according to <4>, wherein a content of the bisphenol A component in a THF-soluble alcohol component of the toner is from 20 mol % to 100 mol %, wherein a content of the bisphenol A component in a THF-insoluble alcohol component of the toner is from 0 mol % to 80 mol %, and wherein the content of the bisphenol A in the THF-soluble alcohol component is greater than the content of the bisphenol A in the THF-insoluble alcohol component.

<6> The toner according to any one of <2> to <5>, wherein a ratio (W/R)/(W'/R') of the peak ratio W/R to the peak ratio W'/R' is from 1.0 to 2.0.

<7> The toner according to any one of <1> to <6>, wherein the content of the THF-insoluble component in the toner is from 10% by mass to 35% by mass.

<8> A developer including:

the toner according to any one of <1> to <7>; and a carrier.

<9> A toner stored unit including the toner according to any one of <1> to <7>, wherein the toner stored unit has stored the toner.

<10> An image forming apparatus including:

an electrostatic latent image bearer;

a charging unit configured to electrically charge the electrostatic latent image bearer;

an electrostatic latent image forming unit configured to form an electrostatic latent image over the electrically charged electrostatic latent image bearer;

a developing unit configured to develop the electrostatic latent image formed over the electrostatic latent image bearer with a toner to form a toner image;

a transfer unit configured to transfer the toner image formed over the electrostatic latent image bearer onto a recording medium; and a fixing unit configured to fix the toner image transferred onto the recording medium, wherein the toner is the toner according to any one of <1> to <7>.

<11> An image forming method including:

an electrostatic latent image forming step of forming an electrostatic latent image over an electrostatic latent image bearer;

a developing step of developing the electrostatic latent image formed over the electrostatic latent image bearer with a toner to form a toner image;

a transfer step of transferring the toner image formed over the electrostatic latent image bearer onto a recording medium; and a fixing step of fixing the toner image transferred onto the recording medium, wherein the toner is the toner according to any one of <1> to <7>.

<12> A process cartridge including:

an electrostatic latent image bearer; and a developing unit configured to develop an electrostatic latent image formed over the electrostatic latent image bearer with a toner to form a toner image, wherein the process cartridge supports the electrostatic latent image bearer and the developing unit in an integrated state, and wherein the toner is the toner according to any one of <1> to <7>.

REFERENCE SIGNS LIST

1 image forming apparatus
10 photoconductor drum
40 developing device
58 corona charger
80 transfer roller
90 cleaning device
110 process cartridge
210 paper feeding section
211 paper feeding cassette
212 paper feeding roller
220 conveying section
221 roller
222 timing roller
223 paper ejecting roller
224 paper ejecting tray
230 image forming section
231 photoconductor drum
233 exposing device
240 transfer section
241 driving roller
242 driven roller
243 intermediate transfer belt
244Y, 244C, 244M, 244K first transfer roller
245 second counter roller
246 second transfer roller
250 fixing device
251 fixing belt
252 pressurizing roller
P paper sheet

The invention claimed is:

1. A toner, comprising a binder resin comprising a polyester resin, wherein an alcohol component constituting the polyester resin comprises a bisphenol A component, wherein the toner has a peak ratio W/R of from 0.20 to 0.70 when measured according to a Fourier Transform InfraRed spectroscopic analysis (FT-IR) method according to an Attenuated Total Reflection (ATR) method, where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$, wherein a molecular weight distribution of the toner obtained by Gel Permeation Chromatography (GPC) of a tetrahydrofuran (THF)-soluble component of the toner has a main peak in a range of from 1,000 to 10,000, and a half value width of the molecular weight distribution is a molecular weight of 20,000 or less, and wherein a content of a THF-insoluble component in the toner is from 5% by mass to 40% by mass.

2. The toner according to claim 1, wherein the toner has a peak ratio W'/R' of from 0.06 to 0.70 when measured according to a Fourier Transform InfraRed spectroscopic analysis (FT-IR) method according to infrared spectroscopy (KBr tablet method), where the peak ratio W'/R' is a ratio of a height W' of a spectral peak of the toner observed at from 1,480 $cm^{-1}$ to 1,520 $cm^{-1}$ to a height R' of a spectral peak of the toner observed at from 1,700 $cm^{-1}$ to 1,750 $cm^{-1}$.

3. The toner according to claim 2, wherein the peak ratio W/R and the peak ratio W'/R' satisfies a relationship below, $W'/R' \leq W/R$.

4. The toner according to claim 2, wherein a ratio (W/R)/(W'/R') of the peak ratio W/R to the peak ratio W'/R' is from 1.0 to 2.0.

5. The toner according to claim 1, wherein a content of the bisphenol A component in a THF-soluble alcohol component of the toner is from 20 mol % to 100 mol %, wherein a content of the bisphenol A component in a THF-insoluble alcohol component of the toner is from 0 mol % to 80 mol %, and wherein the content of the bisphenol A in the THF-soluble alcohol component is greater than the content of the bisphenol A in the THF-insoluble alcohol component.

6. The toner according to claim 1, wherein the content of the THF-insoluble component in the toner is from 10% by mass to 35% by mass.

7. An image forming method, comprising:

forming an electrostatic latent image over an electrostatic latent image bearer;

developing the electrostatic latent image formed over the electrostatic latent image bearer with a toner according to claim 1 to form a toner image, transferring the toner image formed over the electrostatic latent image bearer onto a recording medium; and fixing the toner image transferred onto the recording medium.

8. A toner stored unit, comprising a toner, wherein the toner stored unit stores the toner, wherein the toner comprises a binder resin comprising a polyester resin, wherein an alcohol component constituting the polyester resin comprises a bisphenol A component, wherein the toner has a peak ratio W/R of from 0.20 to 0.70 when measured according to a Fourier Transform InfraRed spectroscopic analysis (FT-IR) method according to an Attenuated Total Reflection (ATR) method, where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$, wherein a molecular weight distribution of the toner obtained by Gel Permeation Chromatography (GPC) of a tetrahydrofuran (THF)-soluble component of the toner has a main peak in a range of from 1,000 to 10,000, and a half value width of the molecular weight distribution is a molecular weight of 20,000 or less, and wherein a content of a THF-insoluble component in the toner is from 5% by mass to 40% by mass.

9. An image forming apparatus, comprising:

an electrostatic latent image bearer;

a charging unit configured to electrically charge the electrostatic latent image bearer;

an electrostatic latent image forming unit configured to form an electrostatic latent image over the electrically charged electrostatic latent image bearer;

a developing unit configured to develop the electrostatic latent image formed over the electrostatic latent image bearer with a toner to form a toner image;

a transfer unit configured to transfer the toner image formed over the electrostatic latent image bearer onto a recording medium; and a fixing unit configured to fix the toner image transferred onto the recording medium, wherein the toner comprises a binder resin comprising a polyester resin, wherein an alcohol component constituting the polyester resin comprises a bisphenol A component, wherein the toner has a peak ratio W/R of from 0.20 to 0.70 when measured according to a Fourier Transform InfraRed spectroscopic analysis (FT-IR) method according to an Attenuated Total Reflection (ATR) method, where the peak ratio W/R is a ratio of a height W of a maximum spectral peak attributed to a bisphenol A skeleton of the toner and observed at from 1,480 $cm^{-1}$ to 1,520 $cm^{-1}$ to a height R of a maximum spectral peak attributed to a carbonyl group of the toner and observed at from 1,700 $cm^{-1}$ to 1,750 $cm^{-1}$, wherein a molecular weight distribution of the toner obtained by Gel Permeation Chromatography (GPC) of a tetrahydrofuran (THF)-soluble component of the toner has a main peak in a range of from 1,000 to 10,000, and a half value width of the molecular weight distribution is a molecular weight of 20,000 or less, and wherein a content of a THF-insoluble component in the toner is from 5% by mass to 40% by mass.

* * * * *